US007278811B1

(12) United States Patent
Yielding et al.

(10) Patent No.: US 7,278,811 B1
(45) Date of Patent: Oct. 9, 2007

(54) LAND AND SEA TRANSPORT SYSTEM FOR PARTICULATE MATERIALS

(75) Inventors: Bryan Yielding, Riceville, TN (US); Joe Calonge, Athens, TN (US)

(73) Assignee: The Heil Company, Chattanooga, TN (US)

( * ) Notice: Subject to any disclaimer, the term of this patent is extended or adjusted under 35 U.S.C. 154(b) by 531 days.

(21) Appl. No.: 10/825,011

(22) Filed: Apr. 15, 2004

Related U.S. Application Data

(60) Provisional application No. 60/463,280, filed on Apr. 16, 2003.

(51) Int. Cl.
*B63B 27/00* (2006.01)

(52) U.S. Cl. ..... 414/139.4; 414/137.1

(58) Field of Classification Search ..... 414/137.4, 414/137.9, 137.1, 137.5, 137.7, 139.4, 139.6, 414/139.7, 139.8, 139.9, 140.1, 140.3 TO, 414/143.2

See application file for complete search history.

(56) References Cited

U.S. PATENT DOCUMENTS 3,352,606 A * 11/1967 Page et al. ..... 406/138
4,085,975 A * 4/1978 Bilkvist ..... 406/109
4,100,872 A * 7/1978 Matsuno et al. ..... 114/73
4,191,314 A * 3/1980 Wahlstrom ..... 222/506
4,206,057 A * 6/1980 Nieuwendijk ..... 210/523
4,362,442 A * 12/1982 Bentzen-Bilkvist et al. 406/109
4,477,210 A * 10/1984 Yare ..... 406/166
4,525,107 A * 6/1985 Feldsted ..... 406/25
4,545,410 A * 10/1985 Paul et al. ..... 141/18
4,756,646 A * 7/1988 Spencer ..... 406/122
5,020,956 A * 6/1991 Marsden ..... 414/138.1
5,341,856 A * 8/1994 Appenzeller ..... 141/67
5,364,218 A * 11/1994 Hara ..... 414/142.4
6,058,557 A * 5/2000 Berndt ..... 15/314
6,609,543 B2 * 8/2003 Sridhar ..... 141/242
6,634,834 B1 * 10/2003 d'Aquin ..... 406/106
6,698,989 B2 * 3/2004 Snowdon ..... 414/137.1
7,101,120 B2 * 9/2006 Jurkovich ..... 406/12

* cited by examiner

*Primary Examiner*—Joe Dillon, Jr.
(74) *Attorney, Agent, or Firm*—Chambliss, Bahner & Stophel, P.C.

(57) ABSTRACT

A multi-modal system for transport of particulate material includes a plurality of ship based hoppers mounted within the hold of a ship. Each such hopper includes a container for particulate material, a container inlet by which particulate material can be loaded into the container by entrainment, and a container outlet through which particulate material can be unloaded from the container by entrainment. The system also includes a product loading internal manifold located within the hold of the ship and connected to a container inlet for a plurality of ship based hoppers, and a product unloading internal manifold located within the hold of the ship and connected to a container outlet for a plurality of ship based hoppers.

11 Claims, 3 Drawing Sheets

LAND AND SEA TRANSPORT SYSTEM FOR PARTICULATE MATERIALS

CROSS REFERENCE TO RELATED APPLICATION

This application claims the benefit of U.S. Provisional Application No. 60/463,280, which was filed on Apr. 16, 2003.

FIELD OF THE INVENTION

This invention relates generally to a system for transporting particulate materials by land conveyance such as truck or railcar, transferring such materials from the land conveyance to a ship-based storage facility, transporting such materials by ship, and offloading such materials from the ship-based storage facility into another land conveyance or storage facility.

BACKGROUND AND DESCRIPTION OF THE PRIOR ART

Many particulate materials are conveniently transported by truck, railcar, barge or by other means. Trucks that are used to transport such materials may include a tractor and an attached trailer having one or more enclosed product containers mounted thereon. Such trailers may also be loaded on railcars or barges, or one or more product containers may be mounted directly on a railcar or barge. Frequently, these transport containers are referred to as pneumatic containers because of the pneumatic method, involving gas- or air-entrainment, by which they may be loaded and unloaded. Materials that are generally stored or transported in pneumatic containers include agricultural products such as grain, corn kernels, beans, flour, sugar, peanuts and the like, lightweight aggregate products, and intermediate products for various industrial uses such as plastic pellets or powders, coke, lime, silica gel, powdered acid resins, rare earth powders and powdered alumina.

Pneumatic containers generally include one or more product compartments that are usually cylindrical or spherical in shape in order to facilitate unloading by a method which involves pressurizing the compartments. Cylindrical or spherical product compartments are also generally easy to completely empty. Each product compartment is provided with a discharge hopper that may be generally cylindrical or conical in shape. The container or the product compartments may be enclosed by a sheet metal sheath, especially when mounted on a trailer or other transport device, which sheath provides an aerodynamically efficient outer surface.

One type of known construction of such pneumatic containers comprises two or more generally cylindrical and horizontally disposed product compartments which are arranged along a common horizontal axis in at least partial fluid communication with each other. A cylindrical or conical discharge hopper is provided for each product compartment, and the axis of each such discharge hopper intersects the product compartment with which it is associated generally at right angles to the axis of the cylinder of the product compartment. Each discharge hopper has a material outlet at the bottom and a valve which controls the entry of material into the outlet. An unloading system is also provided which includes a blower or other mechanism for pressurizing air or another gas. The blower provides the energy required for unloading the material from the container in the form of compressed air or another gas. One end of a pressurizing gas conduit is attached to the blower and the other end to a pressurizing gas inlet in the container. Operation of the blower will compress air or gas and move it through the pressurizing gas inlet into the container, thereby increasing the pressure of the air or gas above the material in the product compartments in the container in order to assist in discharging material through the hopper outlets. One end of a material conveying conduit is also attached to the blower and extends past and connects to each material outlet so that when the product compartment has been pressurized, air or another gas may be directed into the material conveying conduit to entrain material passing through each material outlet and carry it to the discharge end of the conduit. The container may be mounted on a frame which is supported by the chassis of a trailer. Although it is known to transport such trailer mounted containers by barge or ship, such trailer-mounted containers do not provide the maximum product storage for the space they occupy. However, more efficient ship-based product containers for the transport of particulate materials are unknown because of the difficulties inherent in providing for pneumatic loading and unloading of such containers.

It would be desirable, therefore, if a system could be developed by which particulate materials could be transported by a land-based transport vehicle, such as a truck or railcar, loaded onto a barge or ship by a pneumatic method, transported by barge or ship and offloaded by a pneumatic method.

ADVANTAGES OF THE INVENTION

Among the advantages of the invention is that it provides a land and sea transport system for particulate materials, by which particulate materials may be transported by a land-based transport vehicle, such as a truck or railcar, loaded onto a barge or ship by a pneumatic method, transported by barge or ship and offloaded by a pneumatic method.

Additional objects and advantages of this invention will become apparent from an examination of the drawings and the ensuing description.

Explanation of Technical Terms

As used herein, the term "particulate material" refers to granular, fluent or comminuted material that is capable of being transported through a conduit by an entraining gas. As used herein, the term "container" refers to an enclosure for particulate materials that may include one or more product compartments.

As used herein, the term "entrainment" refers to transport by particulate material by a flow of air or another gas.

As used herein, the term "pressurizing gas" refers to the air or gas that is introduced into a product compartment in order to increase the pressure therein.

As used herein, the term "ship" refers to a barge, ship or other vessel adapted to transport cargo over or through a waterway.

As used herein, the term "Ship Based Hopper" or "SBH" refers to a container that is permanently mounted to or in a ship.

As used herein, the term "Shore Based Transport" or "SBT" refers to a truck, trailer, railcar or other land vehicle that includes one or more containers.

SUMMARY OF THE INVENTION

A multi-modal system for transport of particulate material is provided, which comprises a plurality of ship based hoppers mounted within the hold of a ship. Each of these hoppers includes a container for particulate material, a container inlet by which particulate material can be loaded into the container by entrainment and a container outlet through which particulate material can be unloaded from the container by entrainment. The system also includes a product loading internal manifold located within the hold of the ship and connected to a container inlet for a plurality of ship based hoppers and a product unloading internal manifold located within the hold of the ship and connected to a container outlet for a plurality of ship based hoppers. In a preferred embodiment of the invention, the system also includes a product loading dock-side inlet that is accessible to a shore based transport for transfer of particulate material to the ship based hoppers through the product loading internal manifold by entrainment, and a product unloading dock-side outlet that is accessible to a shore based transport for transfer of particulate material from the ship based hoppers through the product unloading internal manifold to a shore based transport.

In its preferred embodiment, the invention comprises a system for transport of particulate materials by land in one or more SBTs to a departure port, loading of such materials into one or more SBHs on a vessel, transport of such materials by sea to a destination port and offloading of such materials into other SBTs.

In order to facilitate an understanding of the invention, the preferred embodiments of the invention are illustrated in the drawings, and a detailed description thereof follows. It is not intended, however, that the invention be limited to the particular embodiments described or to use in connection with the apparatus illustrated herein. Various modifications and alternative embodiments such as would ordinarily occur to one skilled in the art to which the invention relates are also contemplated and included within the scope of the invention described and claimed herein.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
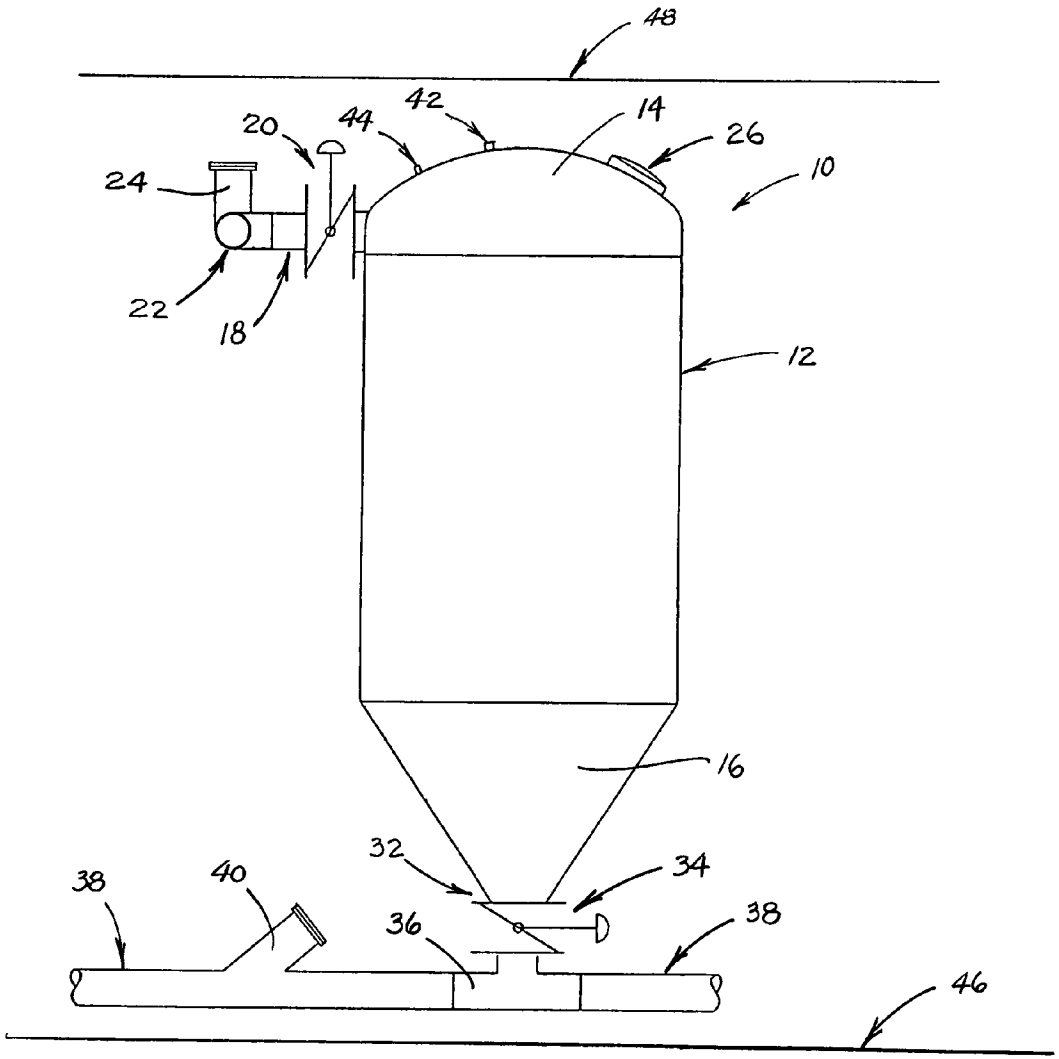
FIG. 1 is a front view of a preferred SBH.
Figure 3:
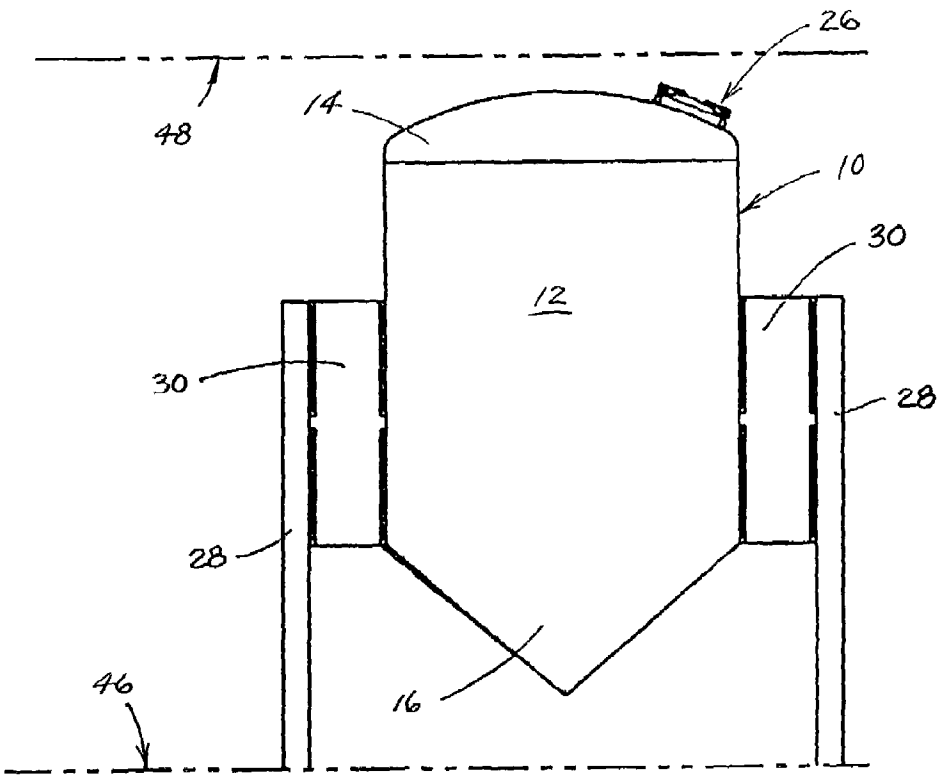
FIG. 3 is a sectional view of the SBH of FIG. 2, taken along the line A-A of FIG. 2.
Figure 2:
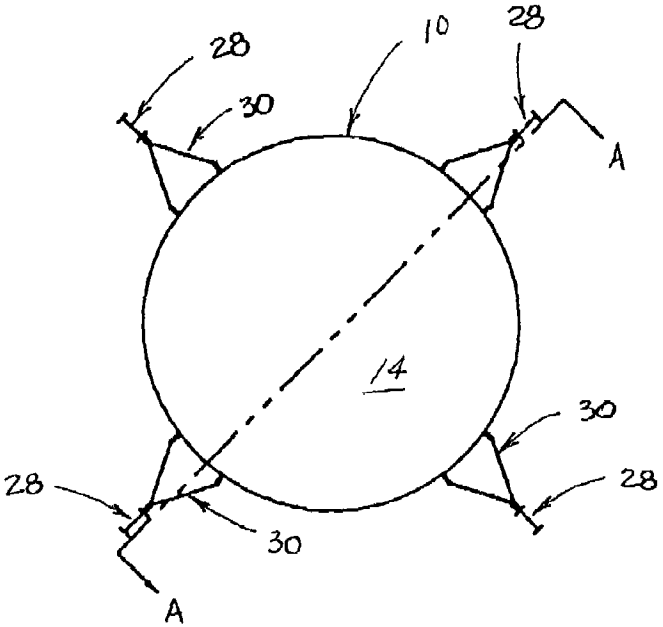
FIG. 2 is a top view of an SBH with its associated support structure according to a preferred embodiment of the invention.

Referring now to the drawings, the method and apparatus of the invention are illustrated in part by the presently preferred embodiments of a SBH. FIGS. 1-3 illustrate a preferred embodiment of SBH 10. SBH 10 is a unique modular design consisting of a generally cylindrical body 12, with an ASME designed dished and flanged head 14 at the top and a conical hopper 16 at the bottom. Preferably, the SBH is constructed of aluminum. Each SBH will also preferably include an inlet nozzle 18 located near the top with an inlet valve, such as pneumatically actuated and electrically controlled butterfly valve 20. Nozzle 18 will facilitate the pressurization and vacuum loading operations of the SBH by conventional pneumatic conveyance methods. The inlet lines for each SBH will be combined in a manifold 22 with that of other SBHs in the ship hold, and preferably one or more clean-outs such as clean-out 24 will be provided in the inlet line manifold. It is also preferred that various inlet lines will combined in manifold 22 serially and that a series of conventional controllers for the inlet control valves 20 is provided in a convenient place so that the SBH's can be filled with particulate material one after another. At a convenient location adjacent to one of the SBHs nearest the exterior of the ship, manifold 22 will preferably be provided with a grooved pipe connection (not shown) to facilitate installation of piping from that point to the inlet line coming onto the vessel.

Each preferred SBH 10 will also be equipped with one heavy duty pressure type dry bulk manhole assembly 26, preferably consisting of a 20-inch aluminum collar, heavy duty cast aluminum cover, six aluminum hold downs with nylon wear plates, and two safety cover retainer safety latches. The manhole is preferably off-set to one side of the top of the SBH for easy access. Each SBH is preferably supported by four galvanized structural steel I-beams 28 which are sized to support the SBH within the hold of the ship. Each preferred SBH will have four I-beam attachment members 30 positioned on 90-degree centers around the circumference of the SBH body 12 and each of these attachment members will bolt to the corresponding I-beam.

At the bottom of each SBH, there will be an outlet 32 with an outlet valve 34, preferably one that is pneumatically actuated and electrically controlled to facilitate product discharge through an outlet tee 36. Preferably, an outlet line manifold 38 will connect the outlet tees of each SBH in the ship hold, and it is also preferred that one or more clean-outs, such as clean-out 40, be provided in the outlet line manifold. It is also preferred that manifold 38 will combine the various outlet tees serially and that a series of conventional controllers for the outlet control valves 34 be provided in a convenient place so that the SBH's can be emptied of particulate material one after another. At a convenient location adjacent to one of the SBHs nearest the exterior of the ship, manifold 38 will preferably be provided with a grooved pipe connection (not shown) to facilitate installation of piping from that point to the outlet or discharge line going off the vessel.

Each SBH will preferably be equipped with an electrically monitored mechanical high level load sensor 42. This sensor will tie in to a PLC or PC controller and will trigger the opening and closing of valves during the loading process. It is also preferred that the inherent loss of pressure observed during the unloading process as each SBH empties will trigger the opening and closing of valves via pressure transducer 44.

Figure 4:
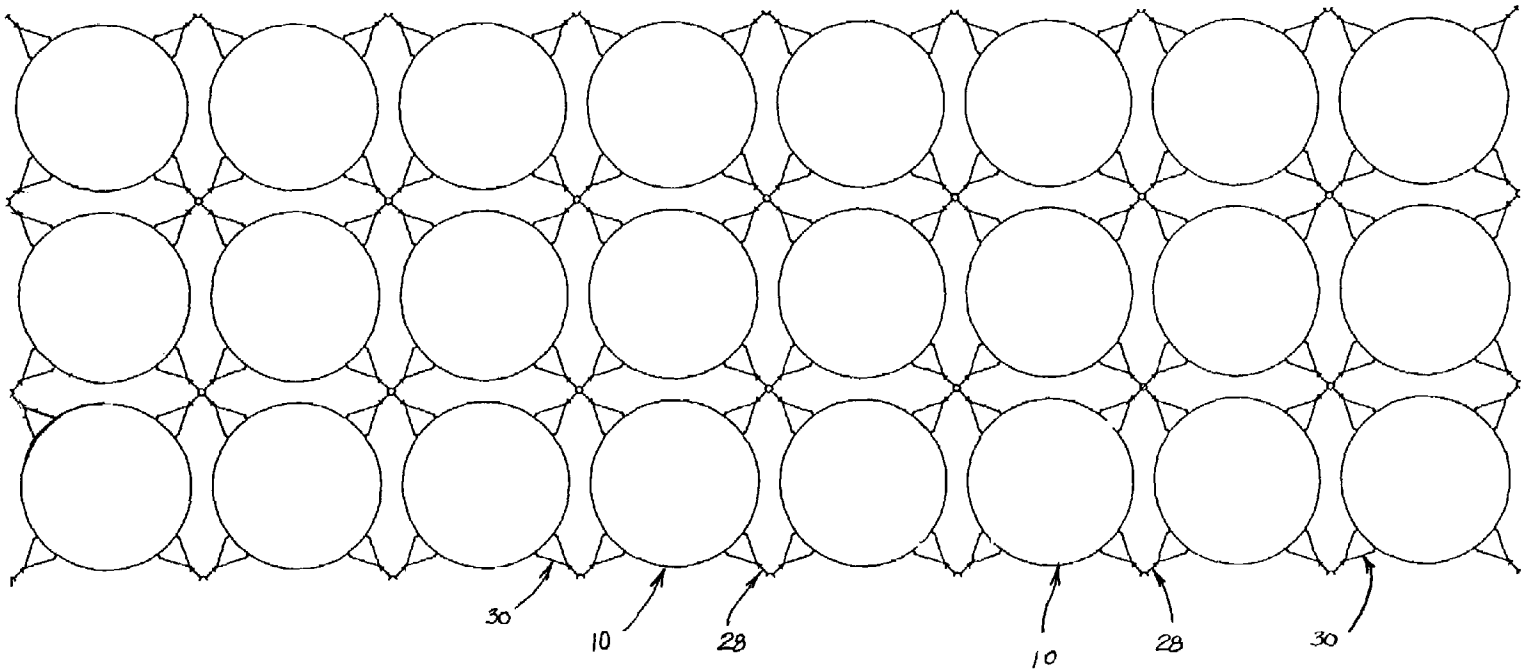
FIG. 4 is a top view of an arrangement of SBHs that may be mounted, according to a preferred embodiment of the invention, in the hold of a ship.

Each SBH is preferably sized so as to be able to fit down an elevator shaft that is approximately 9.5 feet×9.5 feet; however, the SBH may also be constructed of two or more pieces that may be assembled in the hold of the vessel. Preferably, the SBHs are arranged in the vessel in a group of eight SBHs of a suitable capacity, so that when interlinked together, the group of SBHs has a total capacity of 6600 $ft^3$. Such a group of SBHs is capable, for example, of containing 220,000 pounds of particulate resins such as of CPVC, PVC, PET or PE. FIG. 4 shows three groups of SBHs mounted in the hold of a vessel. Each group of eight SBHs is preferably joined by common manifolds, and in a particularly preferred embodiment of the invention, all of the SBHs in the hold are joined by common manifolds.

FIGS. 1 and 3 indicate the location of the SBHs with respect to the floor 46 and ceiling 48 of the vessel hold. Preferably, as shown in FIG. 4, the I-beams from adjacent SBHs are welded or otherwise joined together and mounted on a base flange (not shown) on the floor of the hold of the ship. Preferably, the SBHs can be pneumatically loaded by attaching a product hose from the discharge outlet on an SBT to a product loading dock-side inlet (not shown) such as is known to those having ordinary skill in the art to which the invention relates, and from the dock-side inlet to the inlet manifold for the SBHs. The SBHs can also be unloaded at the destination port by attaching the outlet side of a ship-based blower/compressor (not shown) to the SBH outlet manifold and by entraining or air conveying particulate materials through a product unloading dock-side outlet (not shown) such as is known to those having ordinary skill in the art to which the invention relates, and from the dock-side outlet to the SBT. It is also desirable, in a preferred embodiment of the invention, to provide a connection (not shown) between the ship-based blower/compressor and the inlet line for an SBH to be unloaded (through the inlet manifold), in order to supply a pressurizing gas such as air to the SBH to pressurize the SBH to assist in discharge of material through the SBH outlet tee into the outlet manifold. Such a connection is well-known to those having ordinary skill in the art to which the invention relates. According to this preferred system the product from 10-12 SBHs on a ship could be discharged to 30-36 SBTs.

The SBTs that are used in the system will preferably comprise over-the-road tractors adapted to haul conventional pneumatic trailers such as the Heil Super Flo 2600, the Heil Super Jet 2400 and the J&L 2600 dry bulk pneumatic trailers, all of which are sold by Heil Trailer International of Chattanooga, Tenn. Both the Heil Super Flo 2600 and the J&L 2600 have a capacity of 2600 $ft^3$ and a maximum operating pressure of 15 psi. The Heil Super Flo 2600 is of a monocoque design and the J&L 2600 is of a strut design. Each is capable of hauling up to 73,000 pounds of product. In the alternative, an SBT with a capacity of 2400 $ft^3$ and a maximum operating pressure of 2-Bar or 30 psi, such as one incorporating the Heil Super Jet 2400 strut designed dry bulk trailer, is also contemplated within the scope of the invention, as are other conventional pneumatic delivery systems.

Each pneumatic trailer of the type described herein is provided with a shell, preferably of aluminum, and includes a number of generally cylindrical and horizontally disposed product compartments which are arranged along a common horizontal axis. Conical discharge hoppers are provided, at least one for each product compartment. Each discharge hopper has a material outlet at the bottom and a valve which controls the discharge of material from the outlet of the hopper. An unloading system is also provided which includes a blower or compressor for pressurizing air or another gas or another means or source for supplying a flow of gas. A blower or compressor is typically mounted on the tractor that is used to haul the trailer, and the blower has a pressurizing gas outlet to which one end of a conduit may be attached. The other end of the conduit is attached to the pressurizing system for the product compartments. Operation of the blower will move air or gas into the product compartments, thereby increasing the pressure of the air or gas therein in order to assist in discharging material from the outlets into a material conveying conduit that extends past and connects to each of the hopper material outlets of the product compartments.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations as would be understood by those having ordinary skill in the art to which the invention relates, and the same are intended to be comprehended within the meaning and range of equivalents of the appended claims.

What is claimed is:

1. A system for transport of particulate material comprising:

(a) a plurality of ship based hoppers mounted within the hold of a ship, each of which hoppers comprises:
  (i) a container for particulate material;
  (ii) a container inlet for loading of particulate material into the container by entrainment;
  (iii) a container outlet for particulate material;
  wherein each ship based hopper includes only one container inlet and only one container outlet;

(b) a product loading internal manifold located within the hold of the ship and connected to the container inlet for at least some of the plurality of ship based hoppers;

(c) a product unloading internal manifold located within the hold of the ship and connected to the container outlet for at least some of the plurality of ship based hoppers, said product unloading internal manifold being adapted to transport material received from said ship based hoppers by entrainment.

2. The system of claim 1 wherein a group of eight ship based hoppers are joined by a common product loading internal manifold and a common product unloading internal manifold.

3. The system of claim 1:

wherein:

(a) the product loading internal manifold located within the hold of the ship is connected to a container inlet for each of the ship based hoppers;

(b) the product unloading internal manifold located within the hold of the ship is connected to a container outlet for each of the ship based hoppers; and which includes:

(c) a product loading dock-side inlet that is accessible to a shore based transport for transfer of particulate material to the ship based hoppers through the product loading internal manifold by entrainment;

(d) a product unloading dock-side outlet that is accessible to a shore based transport for transfer of particulate material from the ship based hoppers through the product unloading internal manifold to a shore based transport.

4. The system of claim 1 wherein each of the ship based hoppers comprises a container having a generally cylindrical body section and a conical hopper section located beneath the body section.

5. The system of claim 1:

(a) which includes a controller; and (b) wherein each of the container inlets and container outlets includes a valve; and (c) wherein each of the ship based hoppers includes a load sensor that is connected to the controller and adapted to trigger the opening and closing of the valves during transfer of particulate material to the ship based hoppers through the product loading internal manifold by entrainment.

6. The system of claim 5 wherein each of the ship based hoppers includes a pressure transducer that is connected to the controller and adapted to trigger the opening and closing of the valves during transfer of particulate material from the ship based hoppers through the product unloading internal manifold by entrainment.

7. The system of claim 1 wherein:

(a) a plurality of support structures are provided within the hold of the ship; and (b) each of the ship based hoppers includes a plurality of attachment members, each of which is adapted for attachment to a support structure.

8. The system of claim 7 wherein the ship based hoppers and support structures are arranged so that attachment members of at least two hoppers are secured to each support structure.

9. A system for transport of particulate material comprising:

(a) a plurality of support structures that are provided within the hold of a ship;

(b) a plurality of ship based hoppers mounted within the hold of the ship, each of which hoppers comprises:

(i) a container for particulate material, said container including a generally cylindrical body section, a dome-shaped top section located above the body section, and a conical hopper section located beneath the cylindrical section;

(ii) a container inlet for loading of particulate material into the container by entrainment;

(iii) a container outlet for unloading of particulate material from the container by entrainment;

(iv) a plurality of attachment members, each of which is adapted for attachment to a support structure;

(b) a product loading internal manifold located within the hold of the ship and connected to the container inlet for each ship based hopper;

(c) a product unloading internal manifold located within the hold of the ship and connected to the container outlet for each ship based hopper.

10. The system of claim 9 which includes:

(a) a product loading dock-side inlet that is accessible to a shore based transport for transfer of particulate material to the ship based hoppers through the product loading internal manifold by entrainment;

(b) a product unloading dock-side outlet that is accessible to a shore based transport for transfer of particulate material from the ship based hoppers through the product unloading internal manifold to a shore based transport.

11. The system of claim 9 wherein the ship based hoppers and support structures are arranged so that attachment members of at least two hoppers are secured to each support structure.

* * * * *